United States Patent [19]

Picard

[11] Patent Number: 5,044,039

[45] Date of Patent: Sep. 3, 1991

[54] PROTECTIVE CAP FOR TOOTHBRUSH

[76] Inventor: Pierre E. Picard, 121; 9e Avenue Sud, Sherbrooke, Quebec, Canada, J1G 2P9

[21] Appl. No.: 587,770

[22] Filed: Sep. 24, 1990

[51] Int. Cl.[5] ..... A46B 9/02; A46B 17/04

[52] U.S. Cl. ..... 15/184; 15/167.1

[58] Field of Search ..... 15/167.1, 184; 401/269, 401/202, 213, 98

[56] References Cited

U.S. PATENT DOCUMENTS 1,653,540 12/1927 Bigoney ..... 401/269
3,325,847 6/1967 Meranto ..... 15/184

FOREIGN PATENT DOCUMENTS 2157234 11/1971 Fed. Rep. of Germany ..... 15/184
1155020 4/1958 France ..... 15/184
588587 5/1975 France ..... 15/184
658950 12/1963 Italy ..... 401/269

*Primary Examiner*—Philip R. Coe
*Assistant Examiner*—Terrence R. Till
*Attorney, Agent, or Firm*—Roland L. Morneau

[57] ABSTRACT

A protective cap which is adapted to cover the bristles of a toothbrush grips around the handle adjacent the bristles and surrounds the portion of the handle supporting the bristles while covering the bristles. The new cap extends mainly on one side of the handle except for the neck portion which grips the handle adjacent the bristle and which can be released by angularly moving the cap relative to the handle. The cap is provided with peripheral apertures for allowing ventilation of the bristles.

1 Claim, 2 Drawing Sheets

PROTECTIVE CAP FOR TOOTHBRUSH

BACKGROUND OF THE INVENTION

1. Field of the Invention

The present invention is directed to a cap for a toothbrush and in particular to a cover for the bristles of a toothbrush which grips the handle of the toothbrush adjacent the bristles. The cap is mounted on the toothbrush by pushing it over the bristles in a direction substantially corresponding to the projection of the bristles. The cap is pulled away from the toothbrush in substantially the opposite direction and preferably in a tilting motion considering that the the cap is mainly retained to the narrow portion of the handles of the toothbrush adjacent the bristles.

2. Prior Art

Although the applicant has not made a search directed to a cap for protecting the bristles of a toothbrush, his knowledge of the related art, based on memory, leads him to beleive that his invention is new.

Some known covers for toothbrushes completely surround the bristles including the handle on which they are fixed. These covers are generally introduced over the bristles in a longitudinal direction relative to the handle of the toothbrush.

Some known covers completely enclose the bristles without allowing some possibility of air circulation and some other caps are of the throw-away type.

The present cap preferably allows a circulation of air around the bristles and can be easily removed and snapped back over the toothbrush.

SUMMARY OF THE INVENTION

The invention is directed to a cap for a toothbrush of the type having a handle and bristles projecting from the surface of the handle at one end thereof. The handle is also characterized by a restricted section adjacent the bristles, the end of the handle supporting the bristles forming lateral shoulders on each side of the handles. The cap per se is made of a cover having a U-shaped cross-section adapted to fit over the bristle and surround the end of the handle. The cap also includes a neck portion extending from the U-shaped cross-section but having a restricted cross-section adapted to fit over and grip the restricted portion of the handle. The neck portion releasably grips the restricted portion of the handle and the movement of the cap is longitudinally restricted also by the cap abutting on the front end of the handle. The cap is adapted to be mounted and removed from the toothbrush in a direction corresponding to the bristles or tilted away from the handle.

DETAILED DESCRIPTION OF THE INVENTION

Figure 1:
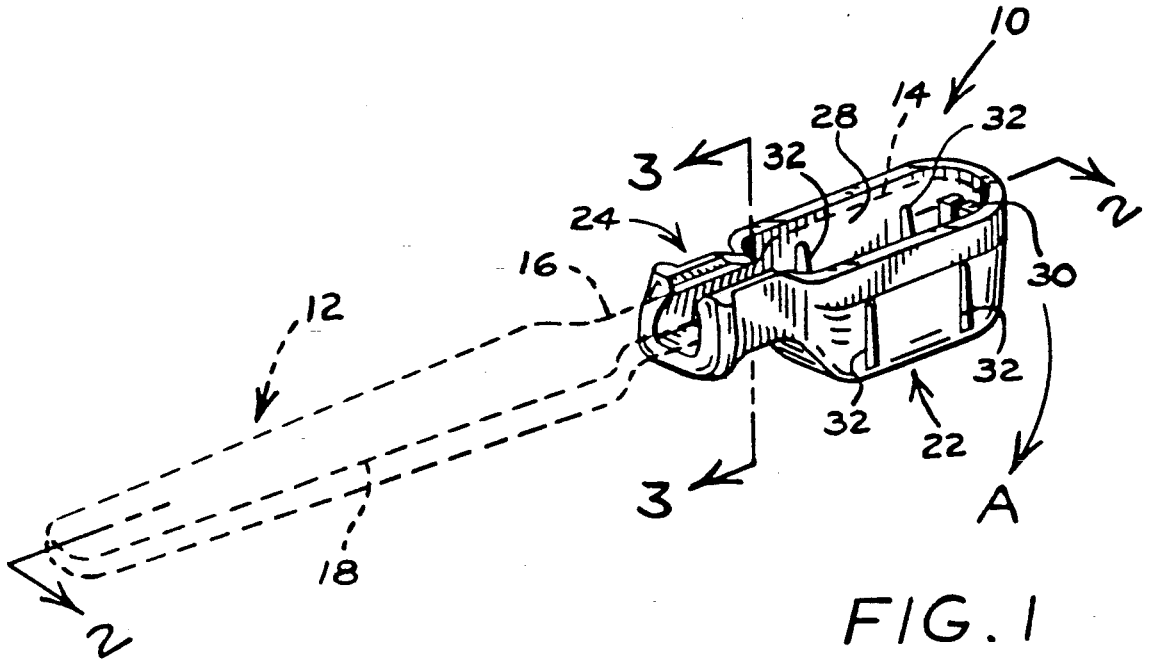
FIG. 1 is a perspective view of the protective cap according to the invention mounted on a toothbrush illustrated in dotted lines.
Figure 3:
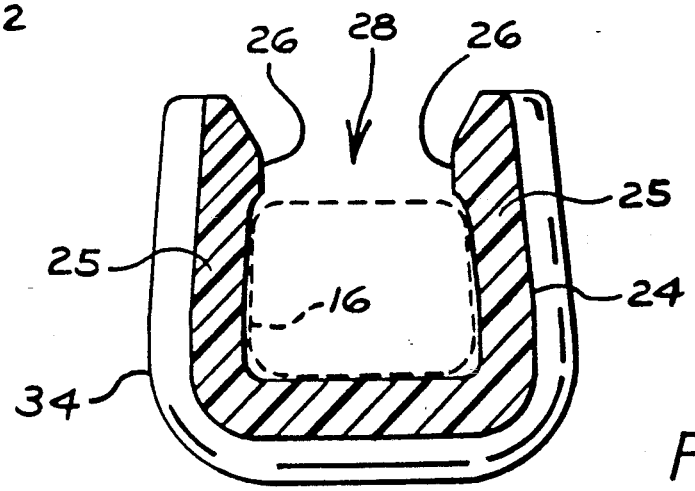
FIG. 3 is an enlarged transversal cross-sectional view along line 3—3 of FIG. 1.
Figure 5:
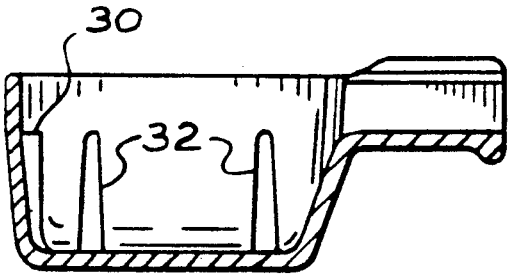
FIG. 5 is a longitudinal cross-sectional view of the cap along line 5—5 of FIG. 4.
Figure 10:
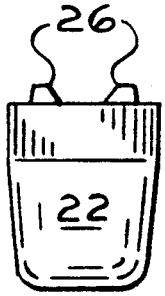
FIG. 10 is an end view of the cap opposite the view of FIG. 8.
Figure 4:
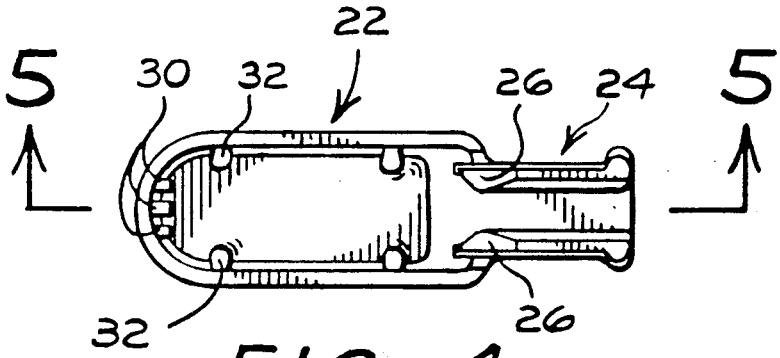
FIG. 4 is a top view of the cap according to the invention.
Figure 6:
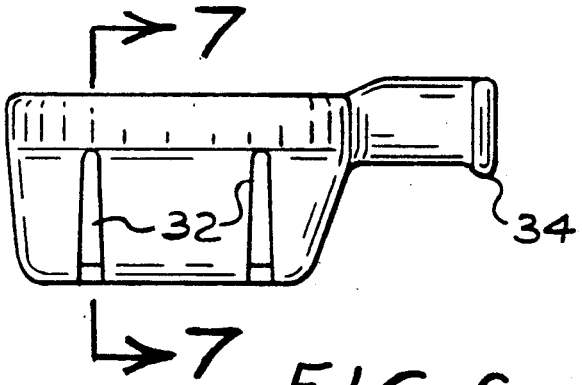
FIG. 6 is a side view of the cap shown in FIG. 4.
Figure 8:
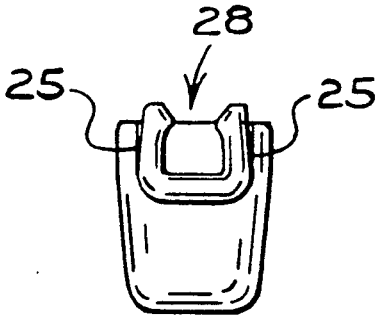
FIG. 8 is an end view of the cap shown in FIG. 4, as seen from the neck portion.
Figure 9:
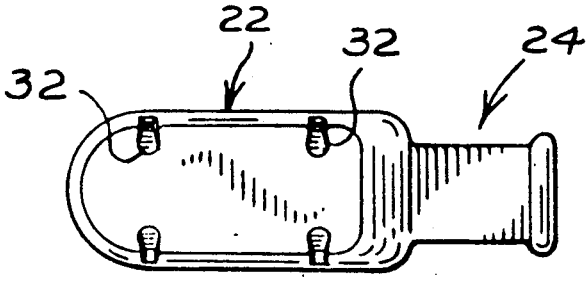
FIG. 9 is a bottom view of the cap shown in FIG. 6.
Figure 7:
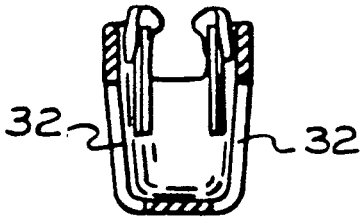
FIG. 7 is a transverse cross-sectional view along line 7—7 of FIG. 6.

FIG. 1 illustrates a cap 10 according to the invention, mounted on a toothbrush handle 12. The handle 12 has a head portion 14, a restricted portion 16 and a grip portion 18. The cap 10 surrounds the head portion 14 and the restricted portion 16 and essentially displays a U-shaped cross-section around the bristles 20 and the restricted portion 16 as shown in FIG. 3.

The cap 10 is made of a cover portion 22 which circles the bristles 20 and the neck portion 24 which partly grips unto the restricted portion 16. The cover 22 surrounds the head portion 14 and the bristles 20 while the backside of the head portion 14 away from the bristles 20 remains open. The neck portion 24 extends from the cover portion 22 and displays a U-shaped cross-section of a smaller size than the cross-section of the cover portion 22 but is provided with internal protuberances 26 which are adapted to grip, partly, the upper face of the restricted portion 16. The gap 28 between both internal protuberances 26 allows the restricted portion 16 of the toothbrush to be pulled out, when the lateral sides 25 of the neck portion 24 are pushed apart by forcing the restricted portion 16 in or out of the gap 28.

The cap 10 is preferably made of a material such as plastic which allows the needed resiliency between the lateral sides 25 of the neck portion 24.

Figure 2:
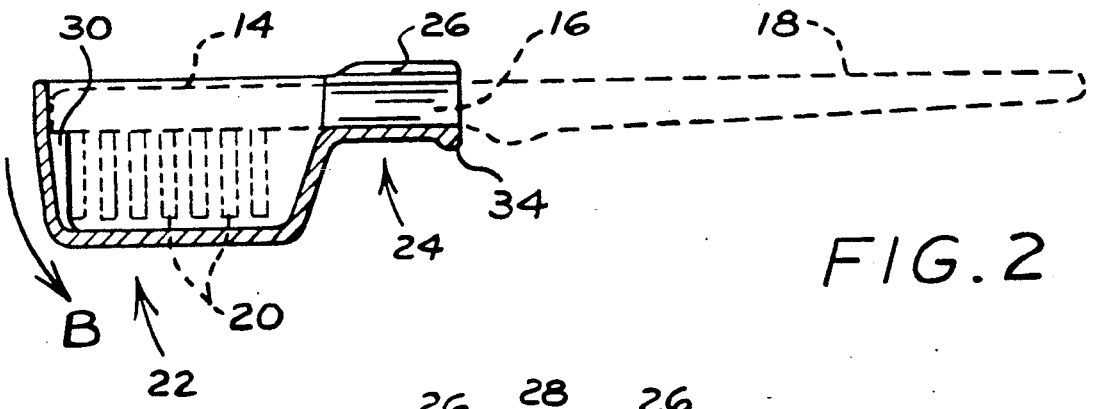
FIG. 2 is a longitudinal cross-sectional view along line 2—2 of FIG. 1.

When the toothbrush is inserted in the cap 10, as shown in FIGS. 1 and 2, and is gripped around the restricted portion 16 by the neck portion 24, the front end of the head portion 14 is adapted to rest on shoulders 30 in order to firmly stabilize the cap 10 on the handle of the toothbrush and more specifically on the restricted portion 16 and the head portion 14. The shoulders 30 are located at the open of beads secured inside the cover 22.

The cover portion 22 has a contour around the head portion 14 of a size allowing a peripheral gap 28 between the contour of the cover and the contour of the head portion 14. This peripheral gap 28 allows a circulation of air therethrough.

The circulation of air which is desired through the bristles in order to dry up the latter, is further improved by slots 32 around the lateral side of the cover 22. The slots extends in the direction corresponding to the direction of the bristles 20 and allow the air to move across the bristles 22 and through the gap 28.

The internal protuberances 26 extend above the upper surface of the restricted portion 16. The length of the neck portion 24 is sufficient to stabilize the cap 10 on the toothbrush under normal conditions such as when the toothbrush covered with its cap 10 is manipulated, transported, carried in a pocket, a purse or in a briefcase. A length of the neck portion 24 of about half an inch is usually sufficient for that purpose.

A bead 34 surrounding the neck portion 24 at the end of the cap 10 reinforces the latter in order to increase its gripping action over the restricted portion 16.

The cap 10 is mounted over the toothbrush by, essentially applying a pressure over the neck portion in a direction corresponding to the direction of the bristles 20. This action spreads the lateral sides 25 of the neck portion 24 which subsequently closes partly over the latter when the cap 10 is in place. In order to release the cap 10 from the toothbrush, the reverse can take place by pulling away the cap 10 in the opposite direction. However, the cover can also be released by tilting it in the direction of the arrow A in FIGS. 1 or 2. This latter motion requires less effort than the former one.

The shape of the cover portion 22 has a U-shaped cross-section of a size which prevents the tip of the bristle 20 to touch the bottom surface of the cover 22 when the head portion 14 of the handle abuts against the shoulders 30. The peripheral contour of the cover portion 22 is also dimensioned so as to prevent it from touching the bristles, for hygienic reasons.

The present cap is particularly advantageous considering that it requires little space and little material to produce, that it gives an adequate protection to the bristles, that it holds well on the toothbrush and allows the bristles to dry up through an adequate air circulation. Such a cap may be sufficient as a protection for selling toothbrushes and can replace the usual and frequently used carton box wrapping completely the toothbrush. Furthermore, such a cap can be kept and reutilized every time after brushing the teeth and for storing the toothbrush.

The present cap, according to the invention, has also the advantage that when toothbrushes are kept adjacent one another, such as standing up, in a glass, on their handle portion 12, the bristles 20 do not touch the bristles of adjacent toothbrushes. The use of such caps over the bristles is useful within the same family when one member has a cold or mouth or teeth disease.

I claim:

1. A protective cap for the bristles of a toothbrush having a handle and bristles projecting perpendicularly from one side of said handle at one end thereof, said handle having a restricted section adjacent said bristles, said cap comprising a cover having a U-shaped cross-section adapted to fit over and around the bristles and to leave open the side of the handle opposite said one side, said cover having a contour dimensioned to have a peripheral air gap between the contour of the cover and the contour of said one end of the handle, a neck portion extending from said cover having a U-shaped cross-section smaller than the cross-section of the cover and extending therefrom, said neck portion having a longitudinal gap over said restricted portion of the handle, on the side opposite the bristles, said neck portion adapted to tightly fit over said restricted portion and to releasably grip the latter for longitudinally and angularly restricting movement of the cover, said cover having lateral walls adapted to surround the bristles, said walls being provided with slots for allowing air circulation across the bristles between said slots and said air gap, a bead internally projecting from said lateral walls at a location opposite said neck portion along a small portion of the contour of the cover, said bead forming a shoulder adapted to abut said one side of said one end of said handle for preventing the free end of the bristles to touch the cover.

* * * * *